US008459931B2

(12) United States Patent
Onishi

(10) Patent No.: US 8,459,931 B2
(45) Date of Patent: Jun. 11, 2013

(54) TURBO-MOLECULAR PUMP

(75) Inventor: Takuto Onishi, Kyoto (JP)

(73) Assignee: Shimadzu Corporation, Kyoto-shi (JP)

( * ) Notice: Subject to any disclaimer, the term of this patent is extended or adjusted under 35 U.S.C. 154(b) by 1378 days.

(21) Appl. No.: 12/132,856

(22) Filed: Jun. 4, 2008

(65) Prior Publication Data

US 2008/0304985 A1 Dec. 11, 2008

(30) Foreign Application Priority Data

Jun. 5, 2007 (JP) ..... 2007-149034

(51) Int. Cl.
*F04D 19/04* (2006.01)

(52) U.S. Cl.
USPC ..... 415/90; 415/199.5; 416/175; 416/198 A

(58) Field of Classification Search
USPC ..... 415/9, 55.1, 55.5, 55.6, 59.1, 72, 415/73, 90
See application file for complete search history.

(56) References Cited

U.S. PATENT DOCUMENTS 5,893,702 A * 4/1999 Conrad et al. ..... 415/71
6,709,226 B2 * 3/2004 Maejima et al. ..... 415/9
6,779,969 B2 * 8/2004 Nonaka et al. ..... 415/90
6,832,888 B2 * 12/2004 Kabasawa et al. ..... 415/90
8,016,512 B2 * 9/2011 Mathes et al. ..... 403/335
2002/0159899 A1 * 10/2002 Yamashita ..... 417/423.4
2003/0175115 A1 * 9/2003 Okudera et al. ..... 415/90
2004/0076510 A1 * 4/2004 Favre-Felix et al. ..... 415/90
2004/0081560 A1 * 4/2004 Blumenthal et al. ..... 417/32
2007/0104598 A1 * 5/2007 Varennes et al. ..... 417/423.4

FOREIGN PATENT DOCUMENTS

JP 2005-105846 A 4/2005
JP 2012017672 A * 1/2012

* cited by examiner

*Primary Examiner* — Ninh H Nguyen
(74) *Attorney, Agent, or Firm* — Sughrue Mion, PLLC

(57) ABSTRACT

A turbo-molecular pump, includes a blade pumping section having a plurality of rotor blades and a plurality of stator blades which are alternately arranged in plural stages along an axial direction of the pump, and a thread groove pumping section having a cylindrical-shaped screw stator, and a rotor cylinder adapted to be rotated inside the screw stator. The rotor cylinder has a lower edge surface located on an upstream side relative to a downstream edge of the screw stator with respect to the axial direction. The turbo-molecular pump of the present invention can minimize flying-out of broken pieces of the rotor cylinder from a discharge port.

12 Claims, 5 Drawing Sheets

TURBO-MOLECULAR PUMP

BACKGROUND OF THE INVENTION

1. Field of the Invention

The present invention relates to a turbo-molecular pump.

2. Description of the Related Art

A turbo-molecular pump for use in semiconductor manufacturing equipment or the like is required to have high evacuation performance and durability against high gas load. In such equipment, a hybrid-type turbo-molecular pump is used which comprises a blade (or turbine blade) pumping section disposed on an upstream side of the pump, and a thread groove pumping section disposed on a downstream side of the pump and adapted to produce an evacuation (i.e., pumping-out) function in intermediate to viscous flow regions (see, for example, JP 2005-105846A).

Typically, the thread groove pumping section comprises a cylindrical-shaped screw stator, and a rotor cylinder adapted to be rotated inside the screw stator at a high speed. The evacuation function of the thread groove pumping section can be enhanced along with an increase in length of the thread groove pumping section in an axial direction of the pump. Thus, with a view to obtaining enhanced function of the thread groove pumping section while facilitating reduction in size of the pump, the thread groove pumping section is designed such that a downstream edge thereof is extended to reach a position of a discharge port provided in a pump base, in some cases.

In cases where the downstream edge of the thread groove pumping section is extended to reach the position of the discharge port, if the rotor cylinder is broken, resulting broken pieces can fly out of the pump through the discharge port. Then, the escaped broken pieces will be sucked into a back pump (e.g., a dry pump) fluidically connected to the discharge port of the turbo-molecular pump, and likely to lead to failures of the back pump.

SUMMARY OF THE INVENTION

In view of the above circumstances, it is an object of the present invention to provide a turbo-molecular pump capable of minimizing flying-out of broken pieces of a rotary cylinder from a discharge port.

In order to achieve this object, the present invention provides a turbo-molecular pump which comprises: a blade pumping section having a plurality of rotary blades and a plurality of stationary blades which are alternately arranged in plural stages along an axial direction of the pump; and a drag pumping section having a cylindrical-shaped stator member, and a rotary cylinder adapted to be rotated inside the stator member, wherein the rotary cylinder has a downstream edge located on an upstream side relative to a downstream edge of the stator member with respect to the axial direction.

The turbo-molecular pump may include a lateral wall provided with a discharge port for discharging therethrough gas pumped out of the drag pumping section, to an outside of the pump, wherein the downstream edge of the stator member is extended to lie within a region of an open end of the discharge port.

The downstream edge of the rotary cylinder may be positioned in such a manner that it is hidden behind the stator member to preclude visual observation thereof from the side of the discharge port.

The stator member may be formed with a thread groove only in a portion of an inner peripheral surface thereof facing the rotary cylinder.

The turbo-molecular pump may include: a rotor having the plurality of rotary blades and the rotary cylinder which are formed therein; a motor adapted to drivingly rotate the rotor; and a pump base member fixedly mounting thereto the motor, wherein the stator member is integrally formed with the pump base member.

As above, the turbo-molecular pump of the present invention can minimize flying-out of broken pieces of the rotary cylinder from the discharge port.

DESCRIPTION OF THE EXEMPLARY EMBODIMENTS

Figure 1:
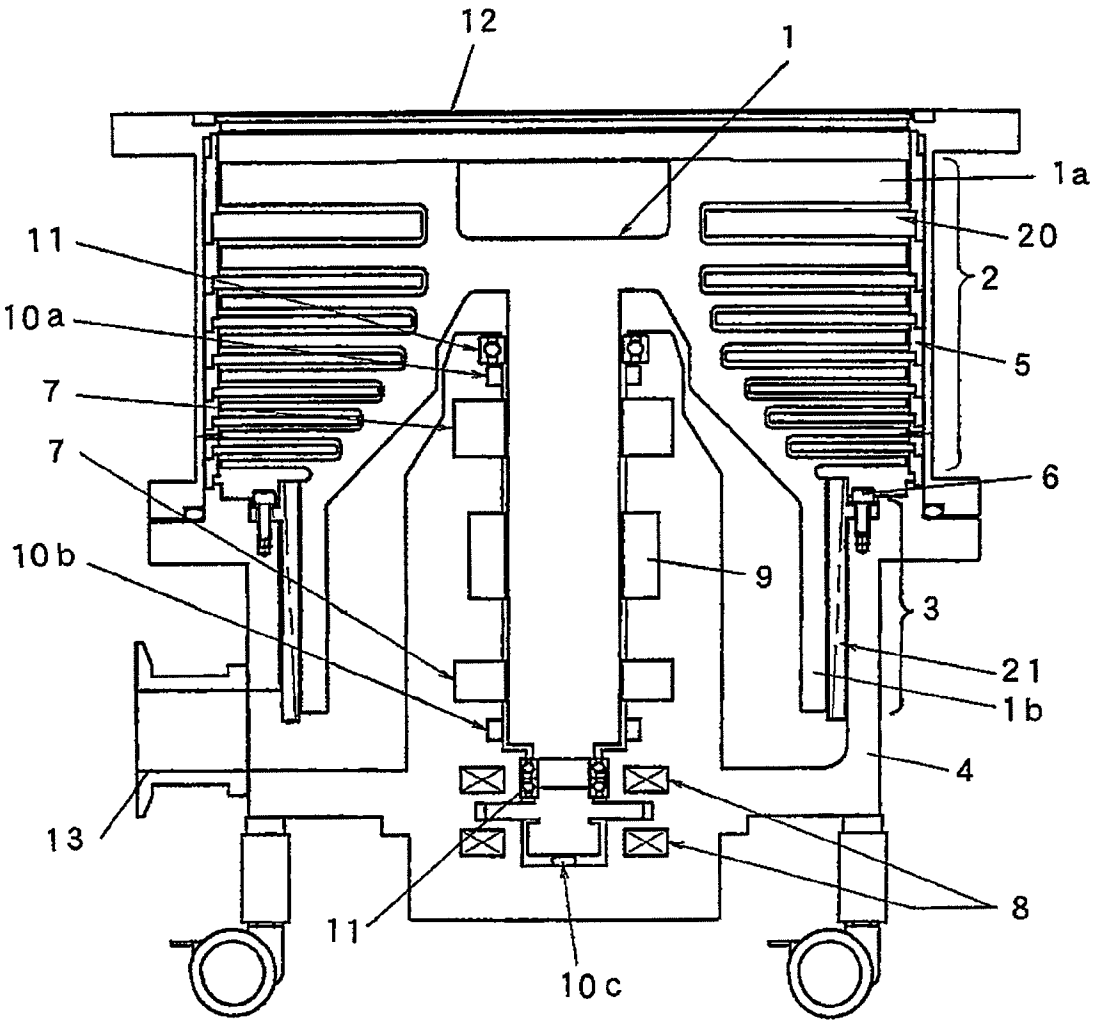
FIG. 1 is a schematic diagram showing a turbo-molecular pump according to one embodiment of the present invention.

With reference to the drawings, the present invention will now be specifically described based on exemplary embodiments thereof FIG. 1 is a sectional view showing a magnetic bearing-type turbo-molecular pump as one example of a turbo-molecular pump according to one embodiment of the present invention. The turbo-molecular pump is a hybrid type having a blade pumping section 2 and a thread groove pumping section 3. The blade pumping section 2 comprises a plurality of rotor blades la arranged in plural stages and a plurality of stator blades 20 arranged in plural stages. The thread groove pumping section 3 comprises a rotor cylinder 1*b* and a screw stator 21.

The rotor blades 1*a* and the stator blades 20 are alternately arranged along an axial direction of the pump (in FIG. 1, along a vertical direction). The turbo-molecular pump includes a base member 4, and a plurality of ring-shaped spacers 5 upwardly stacked on the base member 4. Each of the stator blades 20 has an outer peripheral portion clamped and held by adjacent ones of the stacked spacers 5. The screw stator 21 is formed in a cylindrical shape, wherein an inner peripheral surface thereof is formed with a thread groove, and disposed to face an outer peripheral surface of the rotor cylinder 1*b* with a slight gap therebetween. The screw stator 21 is fixed to the base member 4 by a bolt 6.

The turbo-molecular pump includes a rotor 1 having the plurality of rotor blades 1*a* and the rotor cylinder 1*b* which are formed therein. The base member 4 is provided with a radial magnetic bearing 7 and a thrust magnetic bearing 8 which are adapted to support the rotor 1 in a non-contact manner. The rotor 1 is adapted to be drivenly rotated by a motor 9 while being supported by the magnetic bearings 7, 8 in non-contact manner. A position of the rotor 2 in a magnetically levitated state is detected by a plurality of gap sensors 10*a*, 10*b*, 10*c*. When a magnetic levitation function of the magnetic bearings 7, 8 is not activated, the rotor 1 is supported by a mechanical protective bearing 11.

Gas molecules introduced from an inlet port 12 are pushed downwardly (in FIG. 1) by the blade pumping section 2, and compressed and pumped toward a downstream direction. Then, the rotor cylinder 1*b* is rotated relative to the screw stator 21 at a high speed to produce an evacuation function based on a viscous flow. Thus, the gas transferred from the blade pumping section 2 to the thread groove pumping section 3 is pumped toward the downstream direction while being further compressed. In this embodiment, the thread groove pumping section 3 having a thread groove-based mechanism is employed. A pumping section adapted to produce an evacuation function based on a viscous flow, by means of any mechanism including thread groove-based mechanism is also called "drag pumping section". The gas pumped out of the thread groove pumping section 3 is discharged to an outside of the pump by a back pump (not shown) fluidically connected to a discharge port 13.

Figure 2:
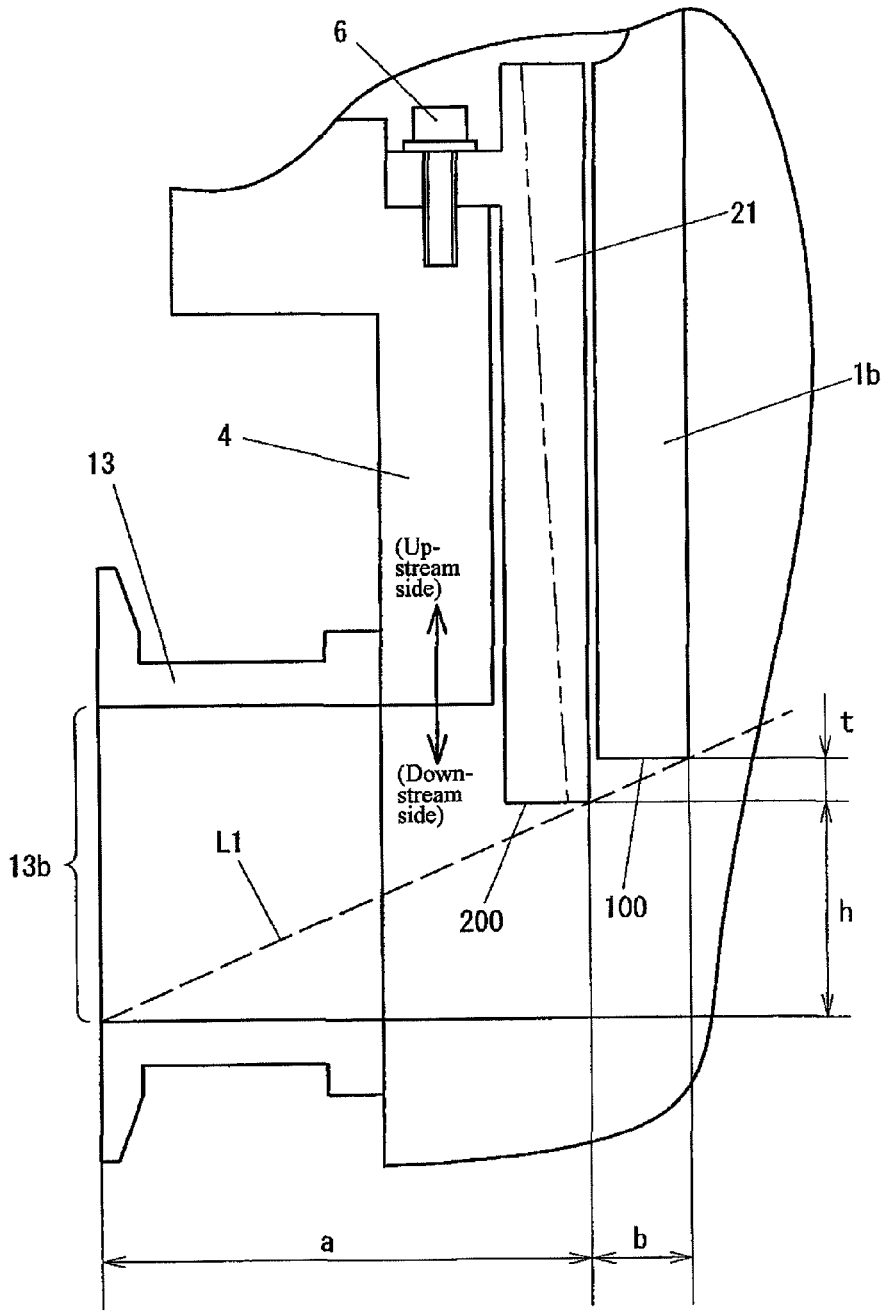
FIG. 2 is an enlarged view showing the structure of a lowermost region of a screw stator 21 and a rotor cylinder 1*b* of the turbo-molecular pump in FIG. 1.

FIG. 2 is an enlarged view showing the structure of a lowermost region of the screw stator 21 and the rotor cylinder 1*b* of the turbo-molecular pump illustrated in FIG. 1. In this embodiment, the rotor cylinder 1*b* has a lower (i.e., downstream) edge surface 100 located on an upstream side (in FIG. 2, on an upper side) relative to a lower edge surface 200 of the screw stator 21. A distance (i.e., positional difference) "t" between the respective lower edge surfaces of the screw stator 21 and the rotor cylinder 1*b* in the axial direction of the pump is determined by a distance "a" between a distal end (i.e., open end) of the discharge port 13 and the inner peripheral surface of the screw stator 21 in a radial direction of the pump, a distance "b" between an inner peripheral surface of the rotor cylinder 1*b* and the inner peripheral surface of the screw stator 21 in the radial direction of the pump, and a distance "h" between a bottom of the discharge port 13 and the lower edge surface 200 of the screw stator 21 in the axial direction of the pump, as will be described in detail later.

Figure 3:
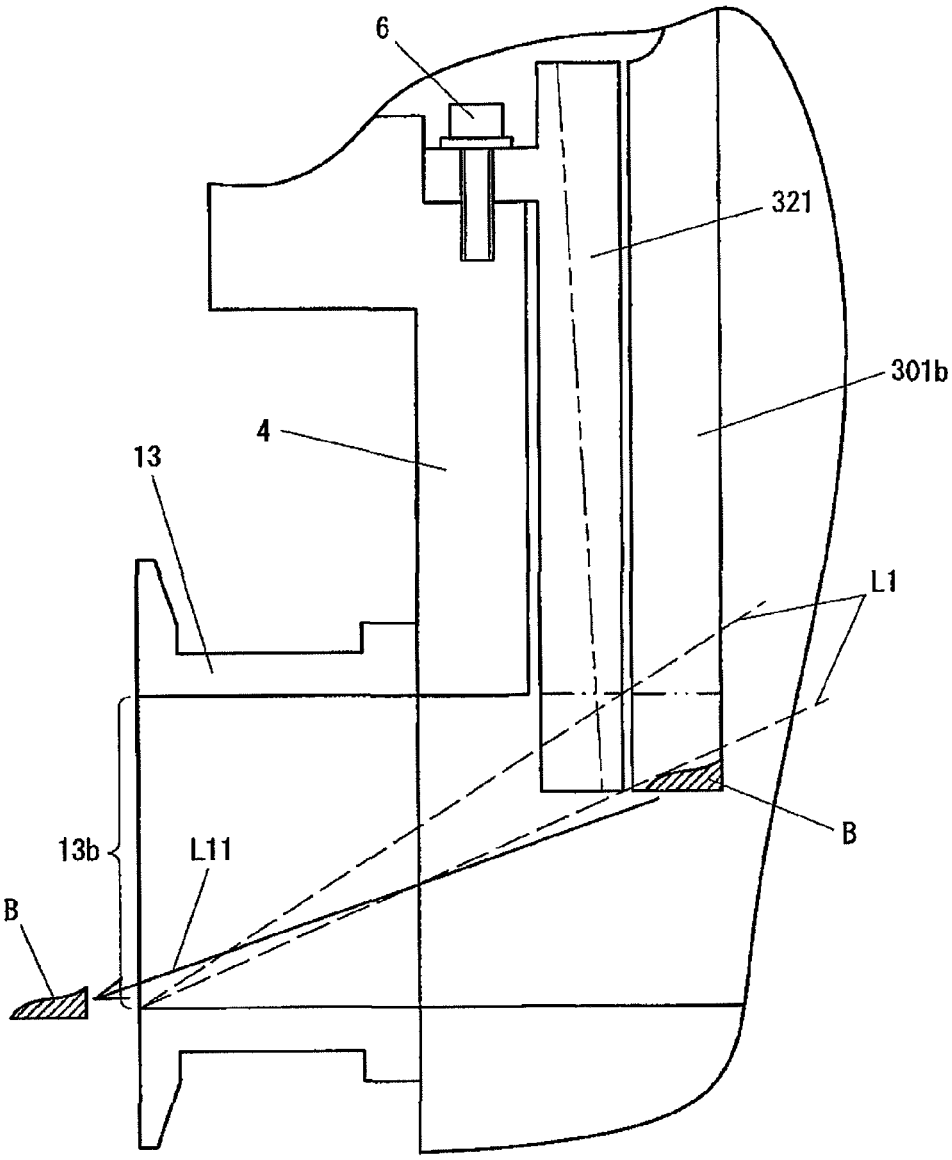
FIG. 3 is an enlarged view showing a relationship between a rotor cylinder 301*b* and a screw stator 321 in a region of a conventional turbo-molecular pump corresponding to that illustrated in FIG. 2.

FIG. 3 is an enlarged view showing a relationship between a rotor cylinder 301*b* and a screw stator 321 in a region of a conventional turbo-molecular pump corresponding to that illustrated in FIG. 2. As mentioned above, the thread groove pumping section 3 is designed to rotate the outer peripheral surface of the rotor cylinder 1*b*, rotated relative to the inner peripheral surface of the screw stator 21, so as to produce an evacuation function. In the conventional turbo-molecular pump, the screw stator 321 and the rotor cylinder 301*b* are formed and arranged such that upper (i.e., upstream) and lower (i.e., downstream) edges of the screw stator 321 are located at the same positions as those of upper and lower edges of the rotor cylinder 301*b*, respectively.

In this structure where the respective lower edges of the screw stator 321 and the rotor cylinder 301*b* are located at the same positions, a lower end of the rotor cylinder 301*b* can be visually observed from the side of a back pump (not shown) through an open end 13*b* of the discharge port 13. In FIG. 3, the code L1 indicates a straight line connecting the lower edge of the inner peripheral surface of the screw stator 321 and a lowermost position of the open end 13*b* (i.e., a position of the open end 13*b* farthest from the lower edge of the inner peripheral surface of the screw stator 321 in the axial direction of the pump). The two-dot chain lines indicate another example where each of the lower edges of the screw stator 321 the rotor cylinder 301*b* is located at the same position as that of an uppermost position of the open end 13*b* (i.e., a position of the open end 13*b* on an opposite side of the farthest position). In this example, the lower end of the rotor cylinder 301*b* can be visually observed through the open end 13*b*.

Thus, a part of broken pieces separated from a lower end B of the rotor cylinder 301*b* located below the solid line (i.e., a downstream side relative to the solid line in the axial direction of the pump) flies out, due to the effect of centrifugal force, in a downward direction as shown with a solid line L11 are likely to get into the back pump through the open end 13*b* of the discharge port 13. Even if a portion of the rotor cylinder 301*b* above the straight line L1 is broken, resulting broken pieces will collide with the screw stator 321 located outside the rotor cylinder 301*b*, and thereby never reach the discharge port 13.

In this embodiment, as shown in FIG. 2, the rotor cylinder 1*b* is formed and arranged such that a lower (i.e., downstream) edge thereof is located on an upstream side (in FIG. 2, on an upper side) relative to a lower edge of the screw stator 21. More specifically, in the embodiment illustrated in FIG. 2, the rotor cylinder 1*b* is formed and arranged such that a lower edge of the inner peripheral surface thereof is located above the straight line L1. This makes it possible to allow broken pieces of the rotor cylinder 1*b* flying off toward the discharge port to collide with the screw stator 21 so as to suppress the broken pieces from intruding into the back pump through the open end 13*b* of the discharge port 13.

Although the discharge port 13 may be designed to have a smaller diameter and/or a larger length so as to reduce the possibility of flying-out of the broken pieces therefrom, such an approach inevitably involves a decrease in conductance of the discharge port 13, which leads to deterioration in evacuation performance of the turbo-molecular pump itself. Therefore, generally, the discharge port 13 is designed to maximize the diameter and minimize the length. As a result broken pieces of the rotor cylinder 1*b* are more likely to fly out of the pump through the discharge port 13.

In order to allow the lower edge of the inner peripheral surface of the rotor cylinder 1*b* to be located above the straight line L1 as shown in FIG. 2, the aforementioned distance "t" in the axial direction of the pump may be set according to the following formula (1):

$$t \geqq bh/a \tag{1}$$

It is understood that even if $t<bh/a$, the intrusion of the broken pieces can be suppressed by allowing the lower edge of the rotor cylinder 1*b* to be located on the upstream side relative to the lower edge of the screw stator 21.

[Modification]

Figure 4:
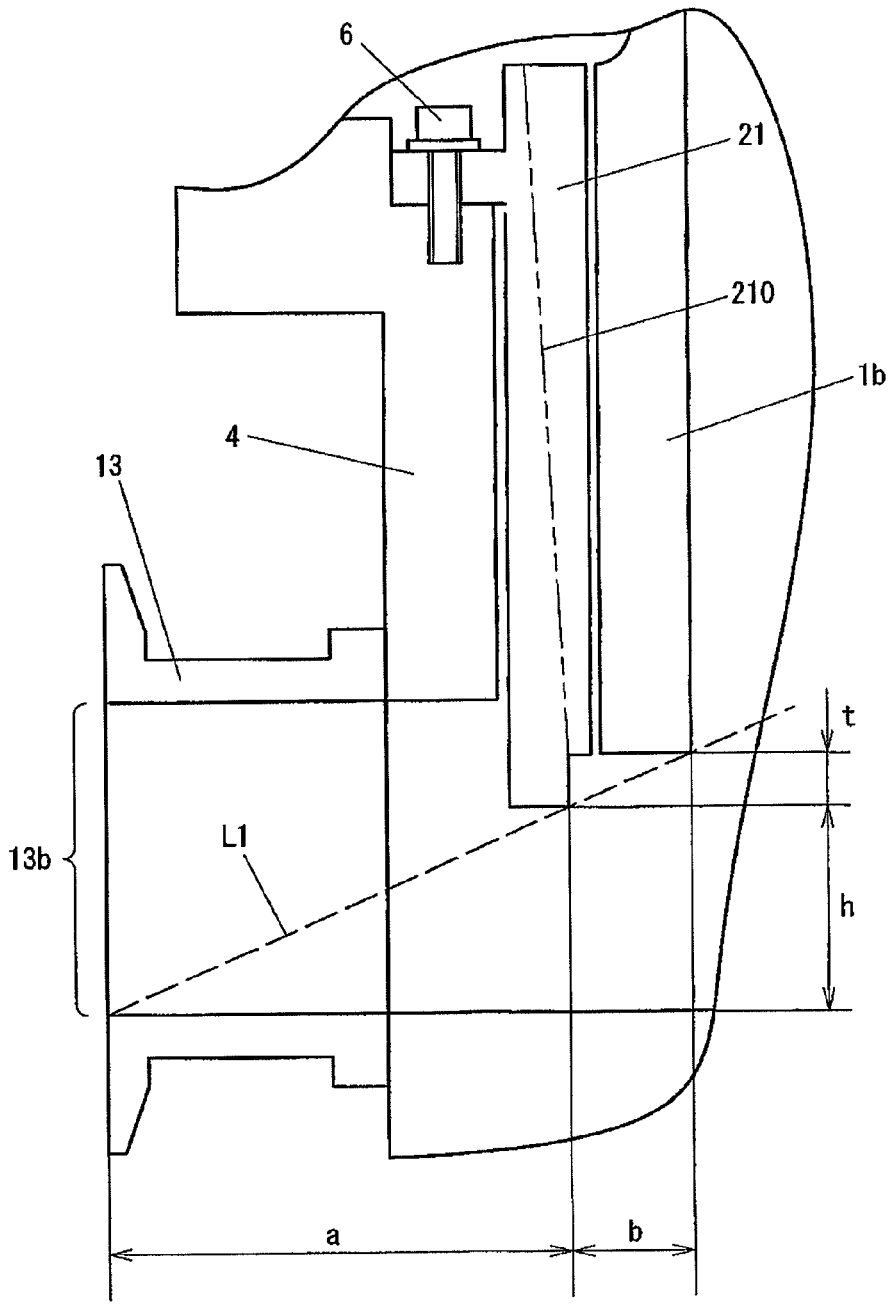
FIG. 4 is an enlarged view showing one example of a modification of the region illustrated in FIG. 2.

FIG. 4 is an enlarged view showing one example of a modification of the region illustrated in FIG. 2. When the rotor cylinder 1*b* is formed and arranged such that the lower edge thereof is located on the upstream side relative to the lower end of the screw stator 21, a specific portion of the inner peripheral surface of the screw stator 21 which falls within the distance "t" from the lower edge thereof, i.e., does not face the outer peripheral surface of the rotor cylinder 1*b*, has almost no contribution to gas evacuation. Thus, a machining of forming a thread groove 210 in this specific portion is omitted to facilitate reduction in machining cost.

Figure 5:
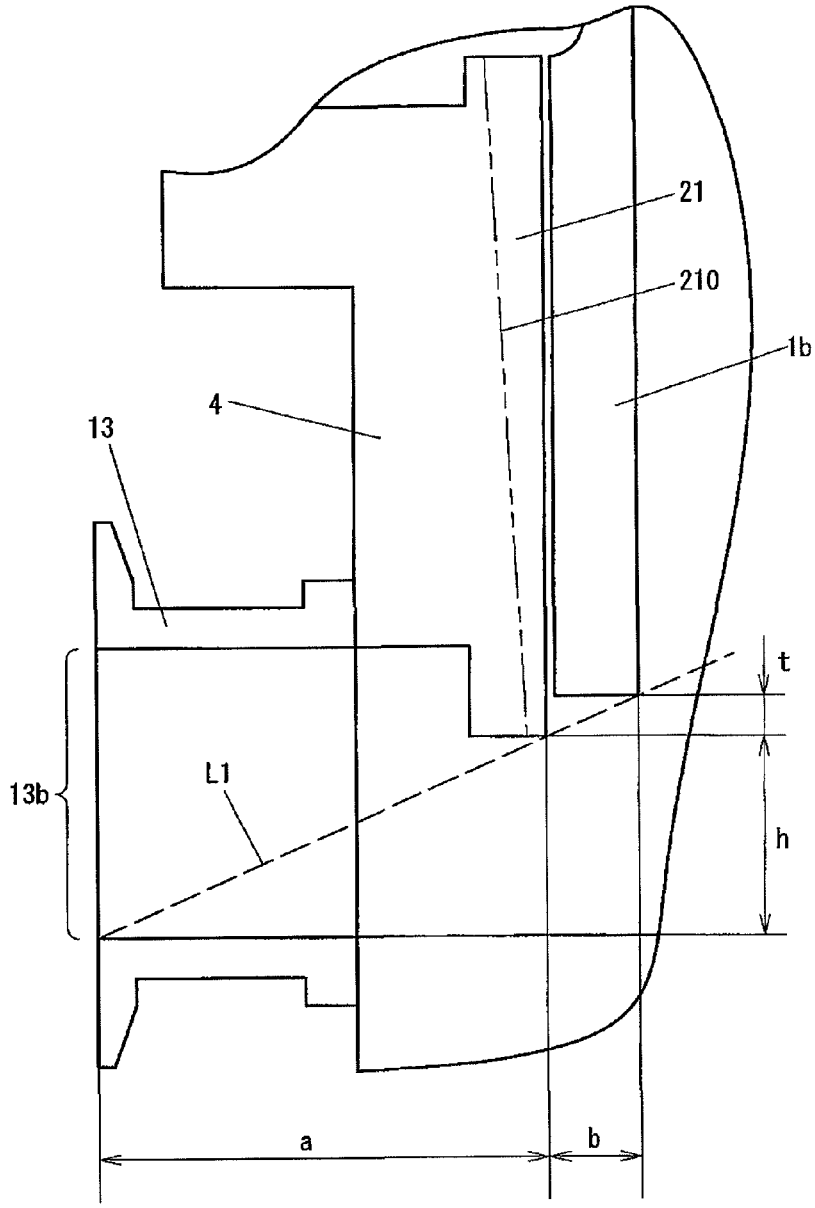
FIG. 5 is an enlarged view showing another example of the modification of the region illustrated in FIG. 2, wherein the screw stator 21 is integrally formed with a base member 4.

In the above embodiment, the screw stator 21 is fixed to the base member 4 by the bolt 6. Alternatively, as shown in FIG. 5, the screw stator 21 may be integrally formed with the base member 4. In this case, each of the respective lower ends of the screw stator 21 and the rotor cylinder 1*b* may have either of the configurations illustrated in FIGS. 2 and 4. While the above embodiment has been described by taking the magnetic bearing-type turbo-molecular pump as one example, the present invention may be applied to any suitable type other than the magnetic bearing-type.

In a correspondence between the above embodiment and elements of the appended claims, the rotor blade 1*a*, the stator blade 20, the thread groove pumping section 3, the rotor cylinder 1*b*, the screw stator 21, the lower edge surface 100, and the lower edge surface 200 in the above embodiment, serve as the rotary blade, the stationary blade, the drag pumping section, the rotary cylinder, the stator member, the downstream edge of the rotary cylinder, and the downstream edge of the stator member in the appended claims, respectively. This correspondence between the above embodiment and elements of the appended claims is described only by way of example, and this description is not meant to be construed in a limiting sense.

What is claimed is:

1. A turbo-molecular pump comprising:

a blade pumping section having a plurality of rotary blades and a plurality of stationary blades which are alternately arranged in plural stages along an axial direction of said pump; and a drag pumping section having a cylindrical-shaped stator member, and a rotary cylinder adapted to be rotated inside said stator member, wherein said rotary cylinder has a downstream edge located on an upstream side relative to a downstream edge of said stator member with respect to said axial direction, and a relationship $t \geqq b \times h/a$ is satisfied, wherein "t" is a distance between respective lower edge surfaces of said stator member and said rotary cylinder in the axial direction of the pump, "a" is a distance between a distal end of a discharge port and an inner peripheral surface of said stator member in a radial direction of said pump, "b" is a distance between an inner peripheral surface of said rotary cylinder and said inner peripheral surface of said stator member in the radial direction of the pump, and "h" is a distance between a bottom of said discharge port and a lower edge surface of said stator member in the axial direction of said pump.

2. The turbo-molecular pump as defined in claim 1, further comprising a lateral wall provided with a discharge port for discharging therethrough gas pumped out of said drag pumping section, to an outside of said pump, wherein said downstream edge of said stator member is extended to lie within a region defining an open end of said discharge port.

3. The turbo-molecular pump as defined in claim 2, wherein said downstream edge of said rotary cylinder is positioned in such a manner that said downstream edge of said rotary cylinder is hidden behind said stator member to preclude visual observation thereof from the side of said discharge port.

4. The turbo-molecular pump as defined claim 3, wherein said stator member is formed with a thread groove only in a portion of an inner peripheral surface thereof facing said rotary cylinder.

5. The turbo-molecular pump as defined in claim 4, further comprising:

a rotor having said plurality of rotary blades and said rotary cylinder which are formed therein;

a motor adapted to drivingly rotate said rotor; and a pump base member fixedly mounting thereto said motor, wherein said stator member is integrally formed with said pump base member.

6. The turbo-molecular pump as defined in claim 3, further comprising:

a rotor having said plurality of rotary blades and said rotary cylinder which are formed therein;

a motor adapted to drivingly rotate said rotor; and a pump base member fixedly mounting thereto said motor, wherein said stator member is integrally formed with said pump base member.

7. The turbo-molecular pump as defined claim 2, wherein said stator member is formed with a thread groove only in a portion of an inner peripheral surface thereof facing said rotary cylinder.

8. The turbo-molecular pump as defined in claim 7, further comprising:

a rotor having said plurality of rotary blades and said rotary cylinder which are formed therein;

a motor adapted to drivingly rotate said rotor; and a pump base member fixedly mounting thereto said motor, wherein said stator member is integrally formed with said pump base member.

9. The turbo-molecular pump as defined in claim 2, further comprising:

a rotor having said plurality of rotary blades and said rotary cylinder which are formed therein;

a motor adapted to drivingly rotate said rotor; and a pump base member fixedly mounting thereto said motor, wherein said stator member is integrally formed with said pump base member.

10. The turbo-molecular pump as defined in claim 1, wherein said stator member is formed with a thread groove only in a portion of an inner peripheral surface thereof facing said rotary cylinder.

11. The turbo-molecular pump as defined in claim 1, further comprising:

a rotor having said plurality of rotary blades and said rotary cylinder which are formed therein;

a motor adapted to drivingly rotate said rotor; and a pump base member fixedly mounting thereto said motor, wherein said stator member is integrally formed with said pump base member.

12. The turbo-molecular pump as defined in claim 1, wherein the stator member has no thread groove on the inner peripheral surface of the stator member near the downstream edge.

* * * * *